US011440169B2

(12) United States Patent
Gauthier et al.

(10) Patent No.: US 11,440,169 B2
(45) Date of Patent: Sep. 13, 2022

(54) TORQUE LIMITING RATCHET WRENCH

(71) Applicant: Gauthier Biomedical, Inc., Grafton, WI (US)

(72) Inventors: Michael T. Gauthier, Grafton, WI (US); Kyle Berndt, Milwaukee, WI (US); Joseph Weasler, Bayside, WI (US)

(73) Assignee: Gauthier Biomedical, Inc., Grafton, WI (US)

( * ) Notice: Subject to any disclaimer, the term of this patent is extended or adjusted under 35 U.S.C. 154(b) by 313 days.

(21) Appl. No.: 16/173,342

(22) Filed: Oct. 29, 2018

(65) Prior Publication Data

US 2019/0126450 A1 May 2, 2019

Related U.S. Application Data

(60) Provisional application No. 62/578,024, filed on Oct. 27, 2017.

(51) Int. Cl.

| | |
|---|---|
| ***B25B 23/142*** | (2006.01) |
| ***B25B 23/16*** | (2006.01) |
| ***B25B 13/46*** | (2006.01) |
| ***B25G 1/00*** | (2006.01) |

(52) U.S. Cl.
CPC ..... *B25B 23/1427* (2013.01); *B25B 13/462* (2013.01); *B25B 23/16* (2013.01); *B25G 1/005* (2013.01)

(58) Field of Classification Search
CPC ... B25B 23/1427; B25B 23/141; B25B 23/14; B25B 23/142; B25B 13/48; B25B 13/462; B25B 23/16; B25B 21/00; B25B 21/004; B25B 21/005; B25B 23/1425; B25B 23/1456; B25B 23/147; B25B 13/10; B25B 13/46; B25B 13/465; B25B 13/481; B25B 13/5091; B25B 17/00; B25G 1/005; B25G 1/00; E21B 19/16
See application file for complete search history.

(56) References Cited

U.S. PATENT DOCUMENTS

| | | | | |
|---|---|---|---|---|
| 728,900 | A * | 5/1903 | George | B25B 13/462 81/177.5 |
| 2,157,574 | A | 5/1939 | Siesel | |
| 2,326,107 | A | 3/1958 | Woods | |
| 3,180,185 | A * | 4/1965 | Schmidt | B25B 13/463 173/93 |
| 3,593,542 | A * | 7/1971 | Urayama | F16D 43/2028 464/37 |

(Continued)

*Primary Examiner* — Robert J Scruggs
(74) *Attorney, Agent, or Firm* — Boyle Fredrickson, SC

(57) ABSTRACT

A fastener driving device including an elongate shaft extending between the driving head and the handle is provided that has a torque limiting mechanism disposed partially within the handle and extending through the elongate shaft into engagement with the driving head. The torque limiting mechanism enables the driving head to drive the fastener into the substrate without exerting more than a predetermined maximum torque on the fastener, thereby avoiding damage from being done to the fastener and/or the substrate. A ratcheting mechanism is disposed within a torque gear of the torque limiting mechanism to provide a ratcheting function to the tool with a small profile for the tool.

10 Claims, 4 Drawing Sheets

(56) References Cited

U.S. PATENT DOCUMENTS

| | | | | |
|---|---|---|---|---|
| 4,382,476 | A * | 5/1983 | Swenson | B25B 19/00 173/93.5 |
| 5,643,089 | A | 7/1997 | Hummel | |
| 7,213,492 | B2 * | 5/2007 | Tsai | B25B 13/463 81/59.1 |
| 7,516,676 | B2 * | 4/2009 | Gao | B25B 23/141 73/862.21 |
| 9,114,509 | B2 * | 8/2015 | Lovely | B25B 13/06 |
| 2011/0154961 | A1 * | 6/2011 | Kan | B25B 13/465 81/478 |
| 2012/0011971 | A1 * | 1/2012 | Ogata | B25B 13/465 81/478 |

* cited by examiner

TORQUE LIMITING RATCHET WRENCH

CROSS-REFERENCE TO RELATED APPLICATIONS

This application claims priority from U.S. Provisional Patent Application Ser. No. 62/578,024, filed on Oct. 27, 2017, the entirety of which is expressly incorporated herein by reference.

FIELD OF THE DISCLOSURE

This invention relates to a device for driving or removing fasteners from a substrate, such as a wrench, that includes a torque limiting mechanism and a ratcheting mechanism to assist in driving the fastener.

BACKGROUND OF THE DISCLOSURE

In the past a variety of different types of tools or devices have been developed to drive fasteners into a substrate for various purposes. One type of device often utilized to drive the fastener is a wrench or similar tool or device that translates the rotation of the wrench by the individual into rotation of the fastener to urge the fastener into the desired substrate.

On many occasions, the particular location where the fastener needs to be located, or the type of substrate into which the fastener is to be driven creates a certain amount of difficulty in driving the fastener into the substrate. To provide some assistance in driving the fasteners in these more difficult situations, many of these devices are constructed with a ratcheting mechanism. The ratcheting mechanism allows the individual to restrict the rotation of the driver to a single direction, which eases the difficulty of driving the fastener.

In addition, to assist in positioning the wrench and the fastener in certain situations the wrench can include an elongate shaft that extends between the handle and the driving head of the tool. The elongate shaft allows the driving head of the wrench to be placed in positions not readily or otherwise reachable with more conventional tool designs.

Nevertheless, with tools and/or wrenches including the elongate shaft the operating mechanisms that can be employed within the handles are necessarily limited by the length and diameter of the shaft extending between the handle and the driving head. Thus, these types of tools are limited with regard to the mechanisms that can be employed therein, as the mechanisms must be positioned within the driving head.

Accordingly, the prior art does not satisfy the needs and solutions desired to improve the functionality of tools including elongate shafts, such that it is desirable to develop a fastener-driving device or tool having an elongate shaft that provides a simple construction for enhancing the functionality of the driving tool.

SUMMARY OF THE DISCLOSURE

A fastener driving device including an elongate shaft extending between the driving head and the handle is provided that has improved functionality in the form of one or more mechanisms disposed within the elongate shaft, in addition to certain mechanisms located within the driving head. The mechanism(s) interact with the driving head to enable the tool to more effectively operate to drive the fastener into the desired substrate.

According to one exemplary embodiment of the disclosure, the mechanism disposed within the driving head of the tool is a torque limiting mechanism disposed partially within the handle and extending through the elongate shaft into engagement with the driving head.

The torque limiting mechanism enables the driving head to drive the fastener into the substrate without exerting more than a predetermined maximum torque on the fastener, thereby avoiding damage from being done to the fastener and/or the substrate. The torque limiting mechanism also serves as a housing for a ratcheting mechanism that is disposed within the torque limiting mechanism. The ratcheting mechanism utilizes portions of the torque limiting mechanism to provide the ratchet functionality to the tool with a much reduced profile for the tool, enabling the tool to be used effectively in tighter locations.

According to other aspects of exemplary embodiments of the present disclosure, the entire torque limiting mechanism can be located within the shaft and not in the handle, housing the ratcheting mechanism therein, or leaving the ratcheting mechanism out of the device entirely.

Numerous additional features, aspects and advantages of the present disclosure will be made apparent from the following detailed description taken together with the drawing figures.

BRIEF DESCRIPTION OF THE DRAWINGS

The drawings illustrate the best mode of practicing the present invention.

In the drawings.

DETAILED DESCRIPTION OF THE DRAWINGS

Figure 1:
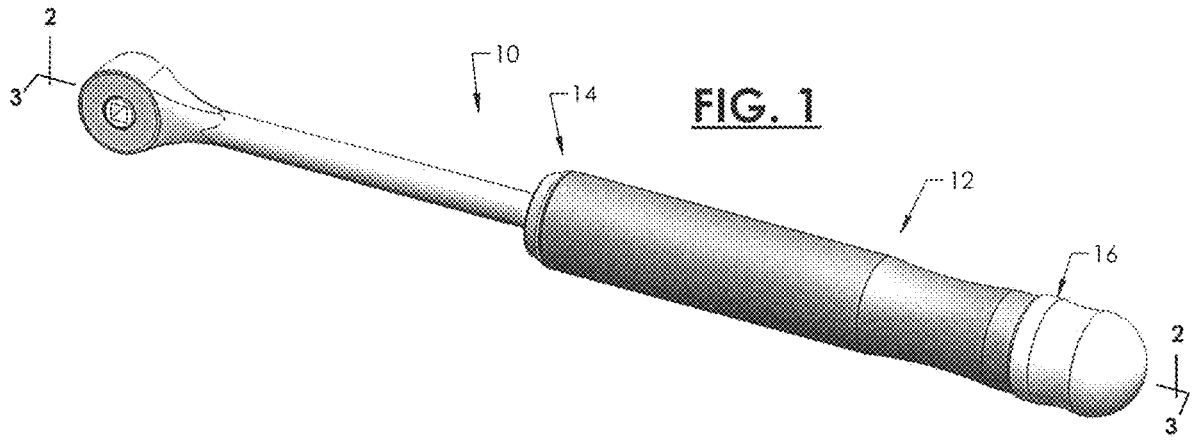
FIG. 1 is an isometric view of a first embodiment of the driving device constructed according to the present disclosure.

With reference now to the drawing figures in which like reference numbers represent like features throughout the application, a tool or device constructed according to the present invention is indicated at 10 in FIG. 1. The device 10 includes a handle 12 having a first end 14 and a second end 16. The shape of the housing 12 can be made to have any desired and ergonomic configuration, and can be made of any suitable material, with a material that is both impervious to fluids and able to be sterilized in any conventional manner being especially preferred. Additionally, the material forming the handle 12 can be selected from a material having the desired properties that can be molded around the other components used in the formation of the device 10.

Figure 2:
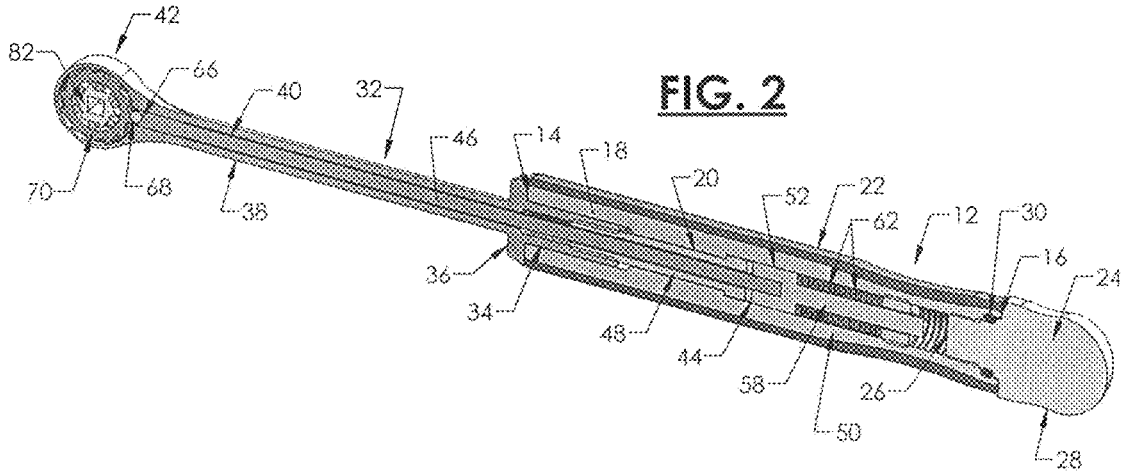
FIG. 2 is a cross-sectional view of the driving device along line 2-2 of FIG. 1.
Figure 3:
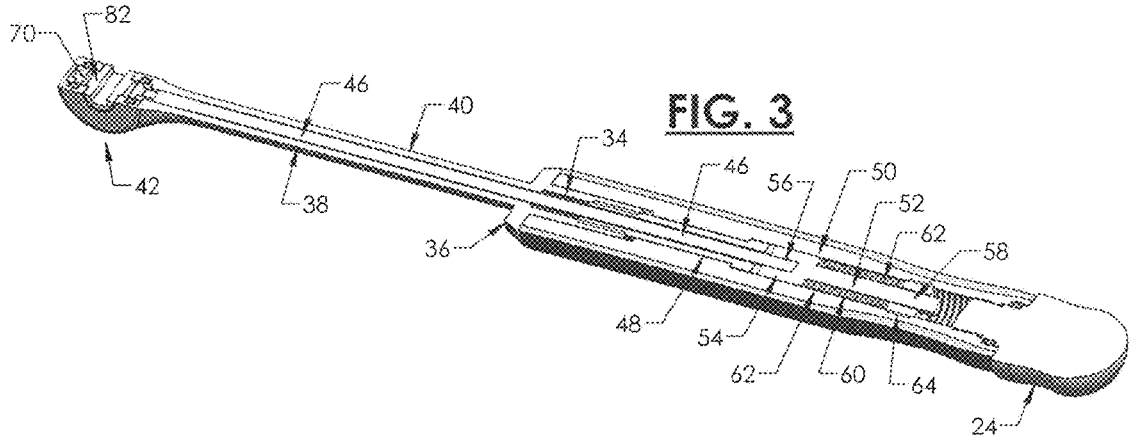
FIG. 3 is a cross-sectional view of the driving device along line 3-3 of FIG. 1.
Figure 4:
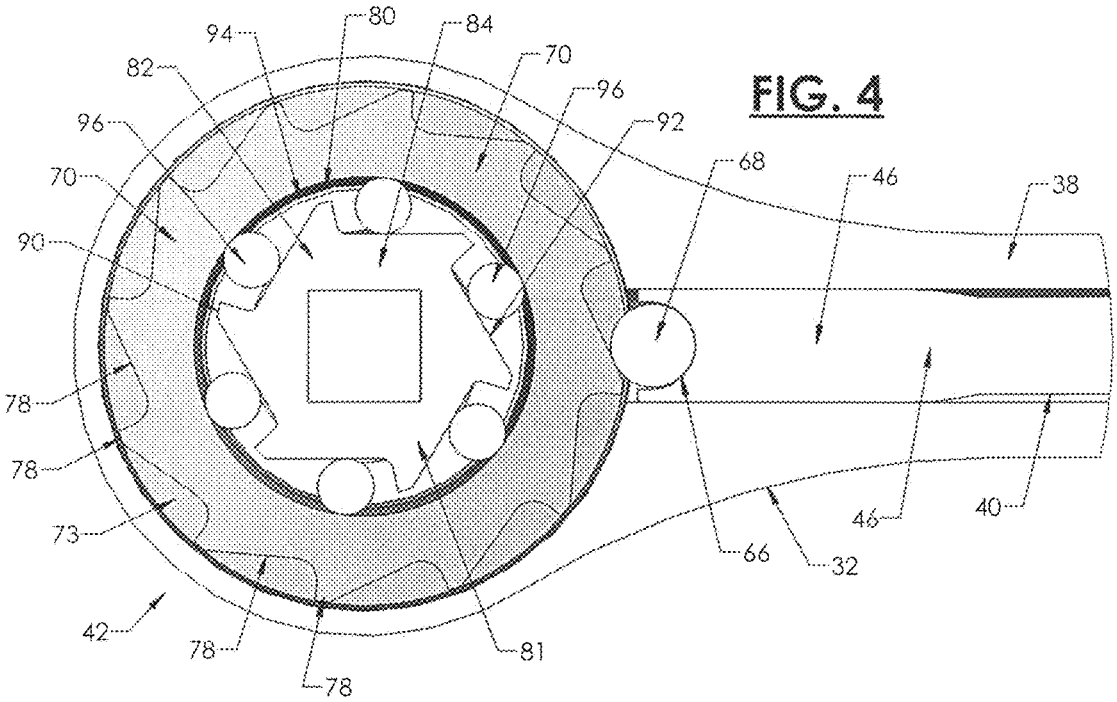
FIG. 4 is a partially broken away top cross-sectional view of the driving head of the device of FIG. 1.
Figure 5:
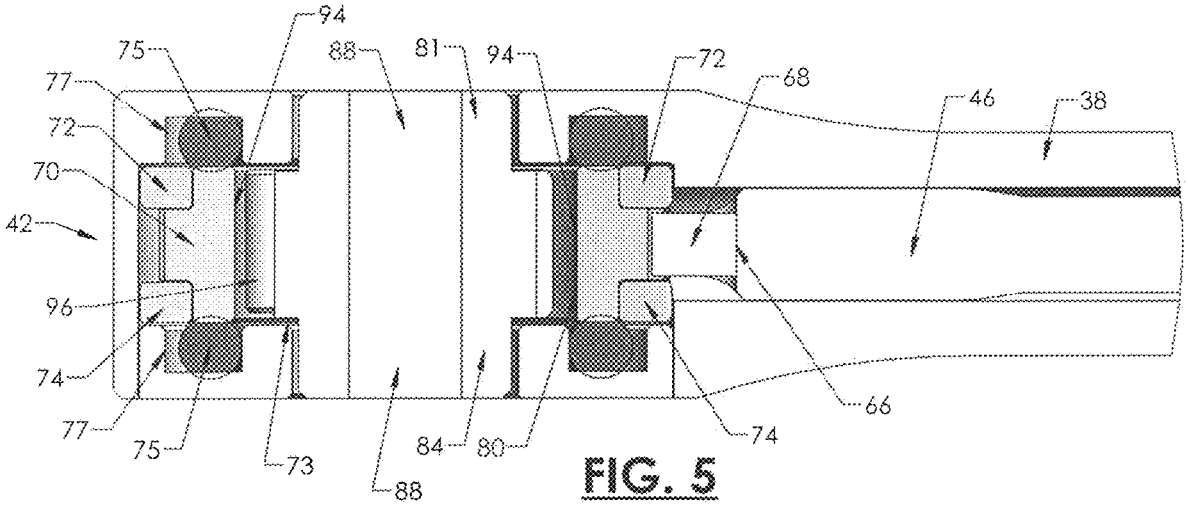
FIG. 5 is a partially broken away side cross-sectional view of the driving head of the device of FIG. 1.
Figure 6:
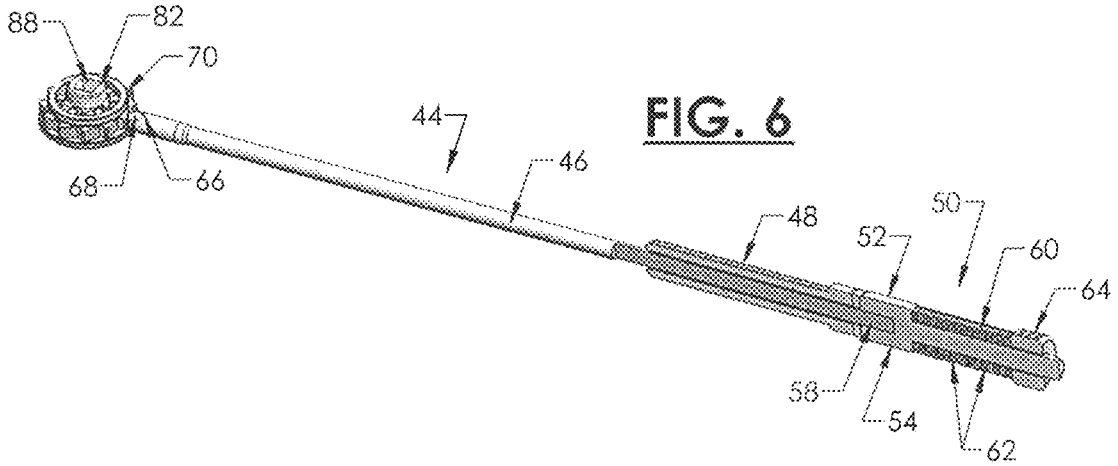
FIG. 6 is an isometric view of the torque limiting mechanism of the device of FIG. 1.
Figure 7:
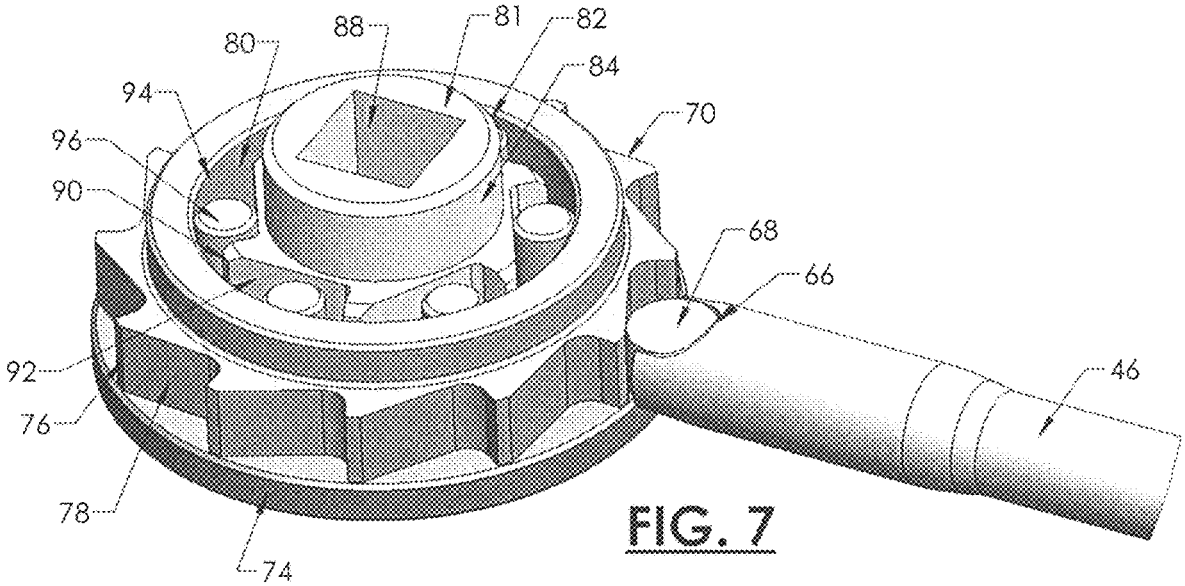
FIG. 7 is a partially broken away isometric view of the driving head of the driving device of FIG. 1.
Figure 8:
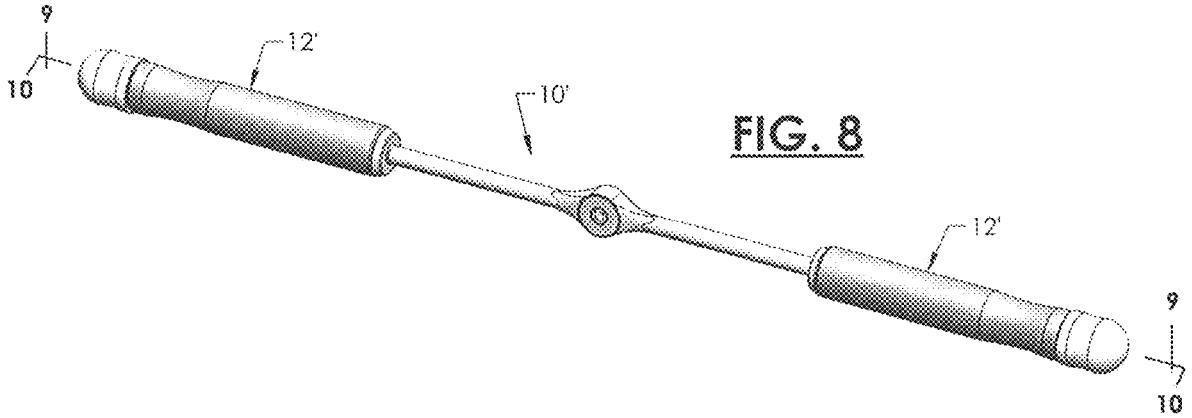
FIG. 8 is an isometric view of a second embodiment of the driving device constructed according to the present disclosure.
Figure 9:
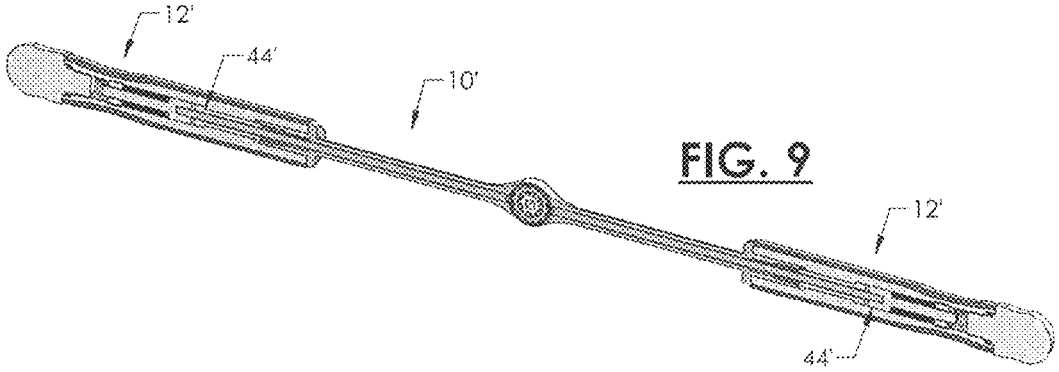
FIG. 9 is a cross-sectional view of the driving device along line 9-9 of FIG. 8.
Figure 10:
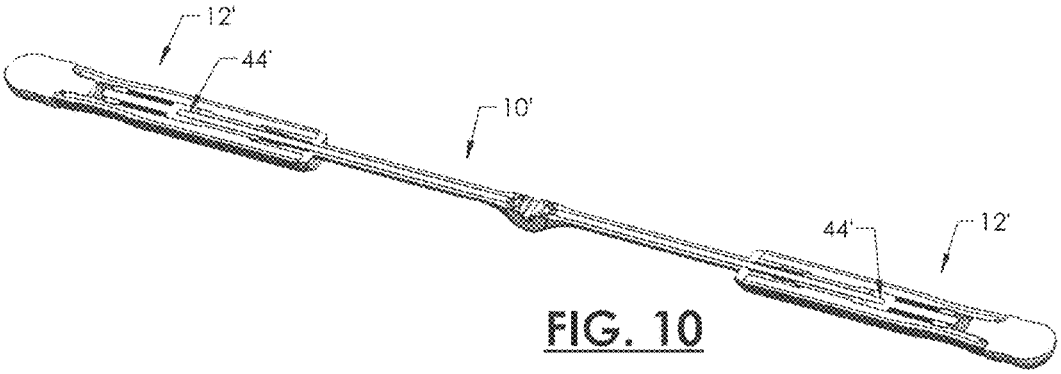
FIG. 10 is a cross-sectional view of the driving device along line 10-10 of FIG. 8.

Referring now to FIGS. 1-3, the handle 12 includes a core 18 formed of a rigid material and defining a central passage 20 extending therethrough. An exterior gripping material layer 22 is formed around the core 18 and extends between the first end 14 and the second end 16. The central passage 20 is closed at the second end 16 by an end cap 24 having a first portion 26 with a diameter less than that of the central passage 20 and insertable therein, and a second portion 28 having a diameter approximately equal to that of the core 18 and the layer 22. The end cap 24 is secured to the core 18 within the central passage 20 in any suitable manner and includes a sealing member 30 positioned between the core 18 and the first portion 26 to prevent fluid, debris or other material(s) from entering the central passage 20 past the end cap 24.

Opposite the end cap 24, the handle 12 includes an elongate shaft 32 engaged with the core 18. The shaft 32 includes an inner section 34 disposed within the central passage 20, a collar 36 disposed against the first end 14 of the handle 12 in engagement with the core 18 and the gripping layer 22, and an outer section 38 extending outwardly away from the first end 14. The shaft 32 is hollow along its length and defines a passage 40 located in axial alignment with the central passage 20 that terminates at a driving head 42 disposed on the shaft 32 opposite the handle 12.

Referring now to FIGS. 2-6 within the passage 40 is disposed a torque limiting mechanism 44. The mechanism 44 includes a biasing bar 46 that is located within and extends the length of the passage 40 from the driving head 42 into the core 18. The bar 46 has a diameter slightly smaller than that of the passage 40 to enable the bar 46 to freely slide within the passage 40. Within the handle 12, the bar 46 extends out of the passage 40 and into the central passage 20 of the core 18. The bar 46 is maintained in alignment with the passage 40 and the central passage 20 by a guide 48 disposed within the central passage 20 adjacent the first end 14.

The bar 46 extends through the guide 48 and is engaged within the core 18 by a biasing mechanism 50. The biasing mechanism 50 is formed with a plunger 52 having a cup 54 adjacent the bar 46 and defining a bore 56 therein capable of receiving the end of the bar 46. A shaft 58 is affixed to and extends away from the cup 54 into engagement with a number of biasing members 60, which in the illustrated exemplary embodiment are shown as spring washers 62. The washers 62 are held in position within the central passage 20 by a number of locking washers 64 engaged within the central passage 20 adjacent the second end 16. The biasing force provided by the washers 62 can be adjusted by varying the number and type of washers 62 utilized, by varying the placement of the locking washers 64 within the central passage 20, or any combination thereof.

Opposite the biasing mechanism 50, as best shown in FIGS. 4-7, the bar 46 terminates with a recess 66 in which is located a torque pin 68. The pin 68 is rotatably retained within and engaged with the recess 66 and engages a torque gear 70 disposed within an aperture 73 in the driving head 42. Alternatively, the pin 68 can be formed as a part of the bar 46 and not as a separate component of the mechanism 44. The torque gear 70 is configured to rotate along an axis perpendicular to the axis of the handle 12 formed with an upper bushing 72 and a lower bushing 74 engage sealing members 75 located within adjacent recesses 77 in the driving head 42 that function to allow the torque gear 70 to rotate within the aperture 73 formed in the driving head 42 while preventing entry of dirt, moisture or other debris into the aperture 73. Between the bushings 72,74 are located a number of teeth 76 spaced equidistant around the perimeter of the torque gear 70 and separated by recess or flats 78.

The torque gear 70 also defines a central aperture 80 within which is disposed a ratcheting mechanism 81 including a ratchet gear 82. The ratchet gear 82 includes a central body 84 disposed within the aperture 80 along an axis perpendicular to the bar 46. A pair of engagement structures 86,88 extend outwardly from ends of the body 84 and can be engaged with complementary fasteners (not shown) or other devices (not shown) such as adapters, sockets or similar members, to engage and drive the fasteners into a substrate. The additional devices can be secured to the engagement structures 86,88 using any suitable releasable securing device or mechanism (not shown). The body 84 is formed similarly to the torque gear 70 with a number of teeth 90 spaced equidistant around and extending outwardly from the perimeter of the body 84 with flats or recesses 92 separating the teeth 90. The teeth 90 as they extend outwardly from the body 84 overlap a portion of the driving head 42 around the perimeter of the aperture 73 in order to operate to retain the torque gear 70 within the driving head 42 while allowing free rotation of the torque gear 70 relative to the driving head 42. In alternative configurations the teeth 90 can be formed as recesses (not shown) or other suitable structures on the body 84 of the gear 70, such as to provide a reduction in the size of the ratcheting mechanism 81 and thus the overall size of the tool 10. Between the interior surface 94 of the aperture 80 and the flats 92 are disposed ratchet pins 96 which are retained in position by portions 97 of the driving head 42 that overlap each end of the pins 96. The pins 96 engage the teeth 90 and move along with the rotation of the body 84 when the ratchet gear 82 is rotated in the counterclockwise direction in FIG. 4. However, to provide the ratcheting function, when the body 84 is rotated in the clockwise direction in FIG. 4, the flats 92 engage the pins 96 and frictionally lock the pins 96 between the flats 92 and the interior surface 94 of the aperture 80 of the torque gear 74. This prevents the body 84 from rotating in the clockwise direction. In alternative embodiments, the orientation of the teeth 90 and flats 92 can be altered to change the direction in which the body 84 can and cannot rotate, and can include other suitable mechanisms (not shown) used to selectively deactivate the ratcheting mechanism 98 formed by the gear 82 and the pins 96.

When the ratchet gear 82 is moved to engage the pins 96 between the flats 92 and the interior surface 94 of the aperture 80, the tool 10 can be used to apply torque to a fastener engaged by one of the engagement structures 86,88 to drive the fastener into a substrate. The torque limiting mechanism 44 can consequently operate to limit the amount of torque that can be applied. In operation, as the torque is applied to the fastener, the torque pin 68 moves from a disengaged position disposed within in the recess or flat 78 between adjacent teeth 76 and is pressed against the recess or flat 78 torque gear 70 due to the bias of the biasing mechanism 50, e.g., the spring washers 62. When the torque being applied by the device 10 becomes greater than the biasing force exerted on the pin 68 by the biasing mechanism 50, the force of the torque being applied will compress the pin 68 and bar 46 inwardly along the passage 40. This movement of the pin 68 allows one or more of the teeth 76 to slip and/or rotate past the pin 68, thereby allowing the ratchet gear 82 to rotate with the torque gear 70, and preventing torque in excess of the biasing force of the biasing mechanism 50 from being applied by the device 10.

In alternative exemplary embodiments, the device 10 can be formed with a pair of handles 12 extending from the drive 42, such as in opposite directions with associated mechanisms formed differently, similarly or identically to mechanism 44 located within each handle each of which engage opposed sides of the torque gear 70 disposed within the drive head 42. Further, the ratchet gear 70 can be formed with only a single engagement structure 86,88 in either embodiment, and the embodiment of the device 10 with two or more handles 12 can be formed with the torque limiting mechanism 44 in only one of the handles 12 if desired.

Various other alternatives are contemplated is being within the scope of the following claims particularly pointing out and distinctly claiming the subject matter regarded as the invention.

We claim:

1. A driving tool comprising:

a) a handle having an open end;

b) a shaft operably connected to the handle having a driving head opposite the handle and disposed at least partially within the open end;

c) a torque limiting mechanism at least partially disposed within the shaft and the driving head; and d) a ratcheting mechanism disposed within and engaged with a portion of the torque limiting mechanism to provide the ratcheting function, wherein the ratcheting mechanism does not include a spring, wherein the ratcheting mechanism includes a ratchet gear disposed within a central aperture defined by the torque limiting mechanism, and wherein opposed ends of the ratchet gear are aligned with each side of the driving head.

2. The driving tool of claim 1 wherein the torque limiting mechanism includes a torque gear disposed within the driving head and extending around a periphery of an aperture extending through the driving head.

3. The driving tool of claim 2 wherein the torque gear is sealingly engaged with the driving head.

4. The driving tool of claim 2 wherein the torque gear defines the central aperture in which the ratcheting mechanism is located.

5. The driving tool of claim 1 wherein the ratchet gear includes a pair of engagement structures extending outwardly from opposite sides of the ratchet gear.

6. The driving tool of claim 1 wherein the ratchet gear includes a number of teeth extending outwardly from the ratchet gear and into the driving head around the periphery of the aperture.

7. The driving tool of claim 6 further comprising a number of pins each disposed between adjacent teeth and engageable with the ratchet gear and the torque gear.

8. A method for limiting the torque applied to a fastener from a driving tool, the method comprising the steps of:

a) providing the driving tool of claim 1;

b) applying torque to a fastener using the driving tool.

9. A driving tool comprising:

a) a handle having an open end;

b) a shaft operably connected to the handle having a driving head opposite the handle and disposed at least partially within the open end;

c) a torque limiting mechanism disposed at least partially within the shaft and the driving head; and d) a ratcheting mechanism disposed within and engaged with a portion of the torque limiting mechanism to provide the ratcheting function, wherein the ratcheting mechanism consists of a ratchet gear including a pair of accessible engagement structures extending outwardly from opposite sides of the ratchet gear and aligned with each side of the driving head, a number of teeth extending outwardly from the ratchet gear and a number of pins each disposed between adjacent teeth and engageable with the ratchet gear and the portion of the torque limiting mechanism.

10. A driving tool comprising:

a) a handle having an open end;

b) a shaft operably connected to the handle having a driving head opposite the handle and disposed at least partially within the open end;

c) a torque limiting mechanism disposed within the shaft and the handle, the torque limiting mechanism including a torque gear located at one end of the shaft and a biasing mechanism engaged with the torque gear, wherein the biasing mechanism comprises:

i. a bar operably engaged with the torque gear at one end;

ii. a plunger including a cup at one end engaged with the bar opposite the torque gear and a shaft extending away from the cup; and iii. a number of biasing members disposed around the shaft and engaged with the cup to bias the cup and bar towards the torque gear; and d) a ratcheting mechanism disposed within and engaged with a portion of the torque limiting mechanism to provide the ratcheting function, wherein each end of the ratcheting mechanism is aligned with each side of the driving head and includes a pair of accessible engagement structures extending outwardly from opposite sides of the ratchet mechanism, and wherein the ratchet mechanism does not include a spring.

* * * * *